United States Patent [19]

Soltes

[11] 4,120,394

[45] Oct. 17, 1978

[54] CASE FOR CARRYING PENDANT AND CHAIN

[76] Inventor: Isaac B. Soltes, 1923 S. McPherrin Ave., Monterey Park, Calif. 91754

[21] Appl. No.: 716,961

[22] Filed: Aug. 23, 1976

[51] Int. Cl.[2] ..... B65D 1/36

[52] U.S. Cl. ..... 206/45.34; 206/560; 206/561; 206/565; 206/566; 206/19; 206/487

[58] Field of Search ..... 206/561, 564, 566, 558, 206/63.3, 565, 19, 560, 45.34, 487; 220/20

[56] References Cited

U.S. PATENT DOCUMENTS

| | | | |
|---|---|---|---|
| 408,576 | 8/1889 | Burt | 206/566 |
| 1,053,896 | 2/1913 | Allen | 206/564 |
| 1,388,094 | 8/1921 | Buttigieg | 206/566 |
| 1,759,189 | 5/1930 | Fishman | 206/560 |
| 2,517,758 | 8/1950 | Allen | 206/566 |
| 2,575,016 | 11/1951 | Hopp et al. | 206/566 |
| 2,651,850 | 9/1953 | Czerwicznik | 206/19 |
| 2,739,697 | 3/1956 | Kuddes | 206/566 |
| 2,827,161 | 3/1958 | Rosa | 206/564 |
| 3,302,776 | 2/1967 | Sparks | 206/564 |
| 3,338,401 | 8/1967 | Regan, Jr. | 206/63.3 |
| 3,640,379 | 2/1972 | Weingarden | 206/558 |
| 3,845,875 | 11/1974 | Douglas et al. | 220/20 |

FOREIGN PATENT DOCUMENTS

| | | | |
|---|---|---|---|
| 1,497,646 | 9/1967 | France | 206/19 |

*Primary Examiner*—William Price
*Assistant Examiner*—Joseph Man-Fu Moy
*Attorney, Agent, or Firm*—William W. Haefliger

[57] ABSTRACT

A jewelry storage device incorporates storage chambers and other structure to retain pendant, chain and clasp elements within a confined space and to prevent chain entanglement.

10 Claims, 13 Drawing Figures

CASE FOR CARRYING PENDANT AND CHAIN

BACKGROUND OF THE INVENTION

This invention relates generally to storage of jewelry, and more particularly concerns a device to receive a pendant, chain and clasp to store same in segregated condition.

Entanglement, knotting and/or kinking of chains per se, and chains attached to clasps and/or pendants has presented problems over long periods of time, especially in the case of fine chains characterized by very small links. Typically, such chains are loosely stored in jewel boxes where entanglement easily occurs. While the chains can be hung vertically, or stored in elongated tubes, they cannot be gathered together with the clasps and pendants in a confined space for storage without substantial risk of entanglement, especially of multiple chains.

SUMMARY OF THE INVENTION

It is a major object of the invention to provide an easily handled device of small size, constructed so as to easily store chain such as that affixed to a pendant and clasp, and preventing chain entanglement, knotting and kinking especially as between multiple chains associated with different clasps and pendants. Basically, the storage device comprises (a) a case defining a pendant chamber, (b) the case defining a storage zone adjacent but outside the storage chamber to receive chain convolutions, and (c) clasp retaining means adjacent but outside the bulk of the storage zone.

As will be seen, the case may include a receptacle and lid, and partitions defining the pendant chamber, and chain and clasp chambers; the partition may define chain passing slots typically located proximate ends of the partitions; and auxiliary partitions on the lid may enter the slots to restrain chain travel, when the lid is closed; the chain storage chamber may be serpentine and contain protrusions acting to separate or divide chain strands; the chain storage chamber may alternatively extend about the pendant chamber; the clasp storage chamber may contain a peg to receive and restrain travel of the clasp; multiple clasp chambers may be formed at interior corners of a receptacle; the lid may support a yieldable insert cushion that covers the partitions to enclose and segregate the chain, clasp and pendant in their respective chambers; and the case may consist of transparent or translucent plastic material to permit viewing of the contents without opening of the case.

As will be appreciated, the cases are small enough so as to be stored in larger jewelry boxes; or, the cases may carry feet to fit in slots in display racks.

These and other objects and advantages of the invention, as well as the details of illustrative embodiments, will be more fully understood from the following description and drawings, in which:

DRAWING DESCRIPTION

DETAILED DESCRIPTION

Figure 1:
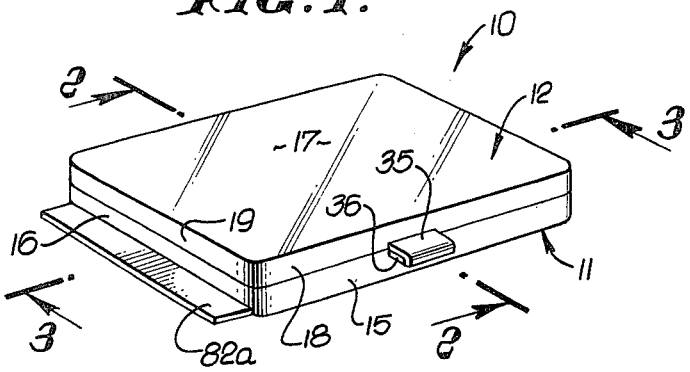
FIG. 1 is a perspective view showing a pendant and chain case embodying the invention.
Figure 2:
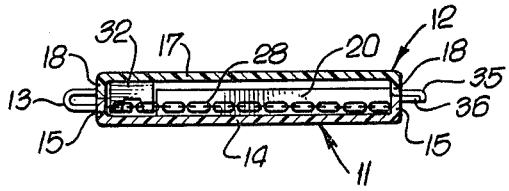
FIG. 2 is a section taken on lines 2—2 of FIG. 1.
Figure 4:
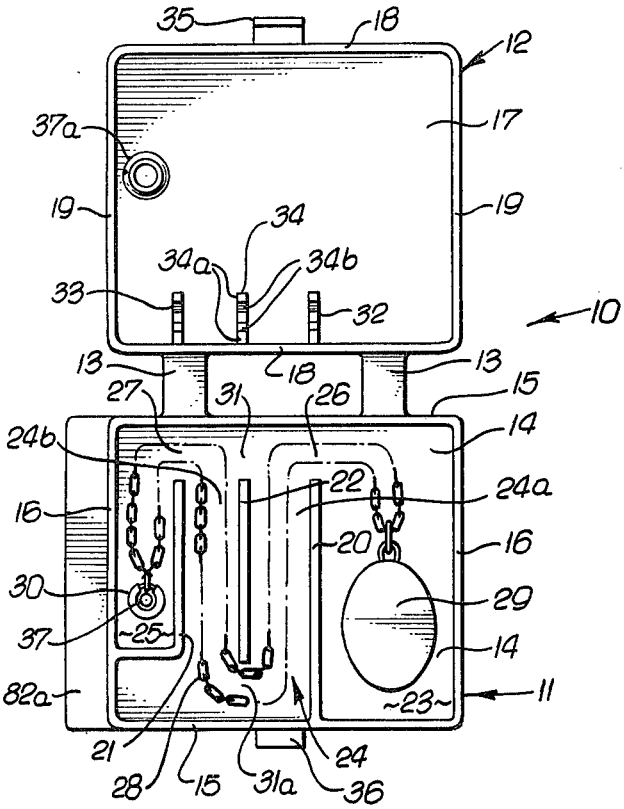
FIG. 4 is a plan view showing the case in open condition.
Figure 3:
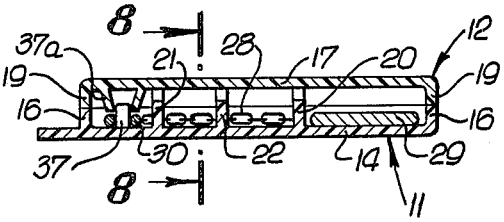
FIG. 3 is a section taken on lines 3—3 of FIG. 1.

Referring first to FIGS. 1–4, the device 10 for storing a pendant, chain and clasp includes a case comprising a receptacle 11 and lid 12. These elements may consist of molded plastic material, which may be transparent, and may have hinges 13 integrally molded therewith, as shown. The generally rectangular receptacle has a bottom wall 14, side walls 15 and end walls 16; likewise, the generally rectangular lid has a top wall 17, side walls 18 and end walls 19. The end walls 16 and 19 are in registration; the side walls 15 and 18 are in registration, and the corners may be rounded, as shown.

In accordance with the invention, the case has partitions, such as are indicated at 20 and 21 for example, and which cooperate with one another and the receptacle walls to define a pendant storage chamber 23, a chain storage chamber 24, and a clasp storage chamber 25. An additional partition 22 may advantageously be provided to divide chamber 24 into serpentine extents **24*a* and 24*b* as shown. The partitions may be parallel, as shown, and typically define local slots, as at 26 and 27, sized to pass local extents of the chain 28 near the pendant 29 and clasp 30. Note that slot 26 is formed between one end of partition 20 and wall 15 nearest hinges 13; the opposite end of partition 20 is integral with wall 15 furthest from hinges 13; slot 27 is formed between one end of partition 21 and wall 15 nearest hinges 13; and that the opposite end of wall 21, on turned portion 21*a* thereof, is integral with end wall 16**.

Figure 8:
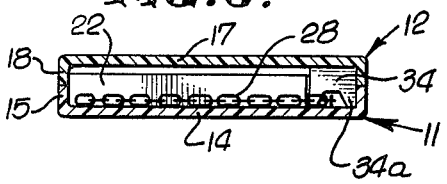
FIG. 8 is a section on lines 8—8 of FIG. 3.

Slots 31 and **31*a* are formed between opposite ends of partition 22 and side walls 15. Auxiliary parallel partitions 32–34 are carried by the lid to project into the respective slots 26, 27 and 31 to partially close same when the lid is closed, the chain extents in slots 26 and 27 being then restricted by the auxiliary partitions from free endwise travel in such slots; however, when the lid is open, the chain may be freely laid into slots 26 and 27, or removed therefrom. Note in FIG. 8 that partition 34 fits closely down on the chain in slot 31, and has feet 34*a* with upwardly tapered inner edges 34*b* between which the chain is confined. Partitions 32 and 33 have the same construction. The lid may be retained in closed position, as by a detent clasp 35 on the lid snapping over a retaining flange 36** on the receptacle.

Figure 6:
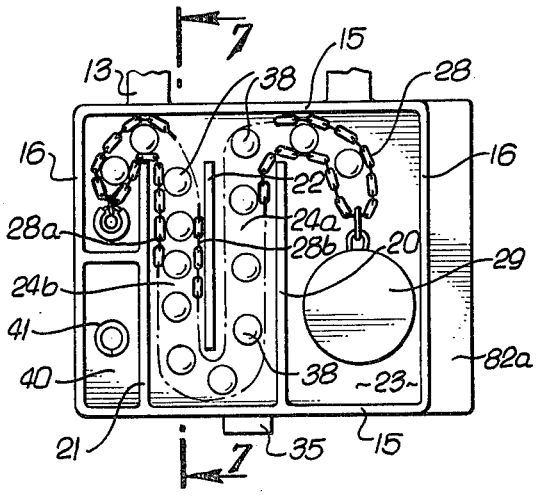
FIG. 6 is a fragmentary view like FIG. 4, showing a further modification.
Figure 7:
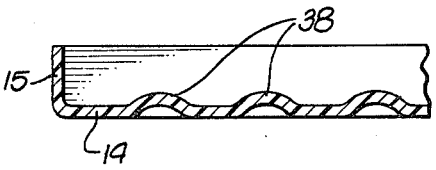
FIG. 7 is an enlarged section taken on lines 7—7 of FIG. 6.

A peg 37 may be provided in the chamber 25 to project upwardly from wall 14 for receiving the encircling clasp, thereby holding it against travel in chamber 25. A ring shaped restraint **37*a* on the lid projects over the clasp when the cover is closed to block slippage of the clasp endwise off the peg. Protrusion means, such as dimples 38 for example, may be integrally molded into wall 14 to project generally centrally into chain storage chamber sections 24*a* and 24*b*, to separate or divide two chain strands 28*a* and 28*b*, as seen in FIGS. 6 and 7, preventing entanglement. Note also the provision in FIG. 6 of an auxiliary chamber 40 in which a bale or jump ring or spring ring 41 may be stored. The construction in those figures otherwise remains the same as in FIGS. 1–4**, and bears similar element numbers.

Figure 5:
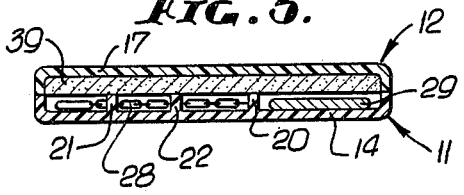
FIG. 5 is a view like FIG. 3, showing a modification.

FIG. 5 shows the provision of yieldable insert means, such as plastic foam cushion 39 attached (such as bonded) to the lid wall 17. The insert layer is sufficiently thick to bear against the upper edges of the partitions 20–22, to block off intercommunication of the chambers 23–25 over those edges, aiding retention of the pendant, chain and clasp in their respective chambers, and preventing chain entanglement.

It will be appreciated that the overall size of the case is typically less than about 1½ inches on a side, so that multiple cases may be stored in a jewelry box.

Figure 9:
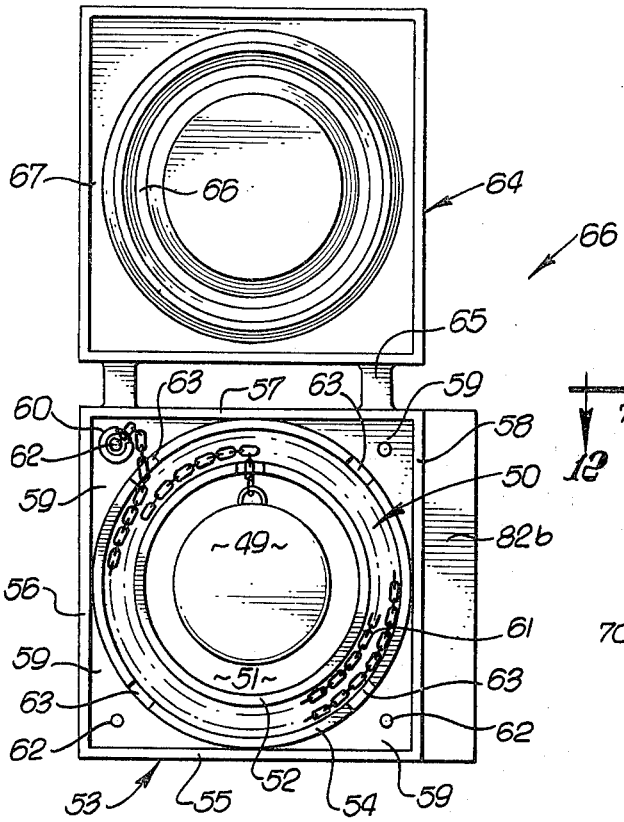
FIG. 9 is a plan view of a modified case.
Figure 10:
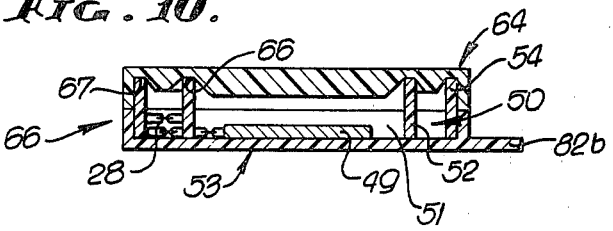
FIG. 10 is a side elevation, in section, of the FIG. 9 case, in closed condition.

FIGS. 9 and 10 illustrate another form of the invention wherein a chain storage zone 50 extends circularly about a chamber 51 for pendant 49. A circular partition 52 in a rectangular receptacle 53 separates zones 50 and 51. Another concentric partition 54 surrounds zone 50 and forms, with the receptacle walls 55–58, four corner zones 59. Any of the latter are adapted to receive the clasp 60, depending on the length of the chain 61 wound in zone 50. Pegs 62 may be located in zones 59 to receive and retain the clasp, and slots 63 are located in partition 54 close to the pegs or corners, to pass the chain. A rectangular lid 64 has hinge connection at 65 to the receptacle, to define a case 66. Annular grooves 66 and 67 in the lid interfit the partitions, as seen in FIG. 10.

Figure 11:
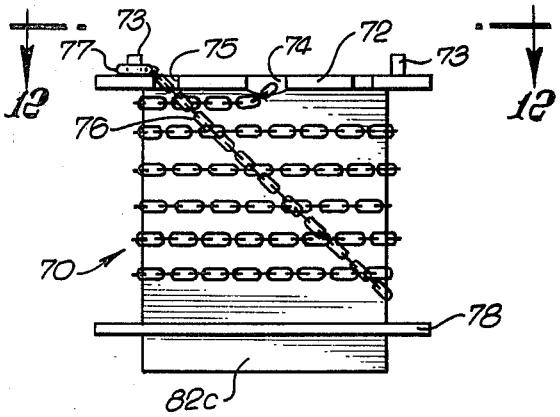
FIG. 11 is a side elevation of still another case.
Figure 12:
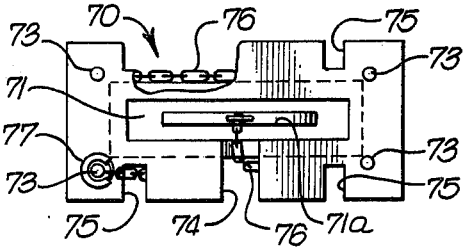
FIG. 12 is an end view of lines 11—11 of FIG. 11.

FIGS. 11 and 12 illustrate still another form of the invention wherein a chain storage zone 70 extends about a chamber 71 for a pendant. Zone 70 is openly exposed to the exterior, and the chamber 71 defines a slot **71*a* to receive the pendant at one end of the chamber. Partition or wall 72 on the chamber separates the clasp storage means (such as protruding peg 73) from the zone 70. Chain 76 passes through a slot 74 in partition 72 to reach winding zone 70, and then passes through a slot 75 in partition 72 to reach the peg for clasp 77. Another partition 78 may be located on the case, to confine the chain windings between partitions 72 and 78**.

Figure 13:
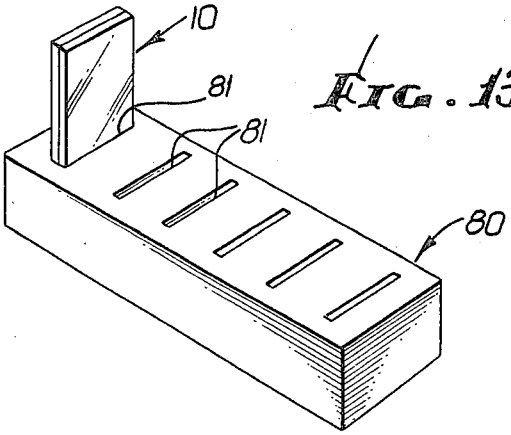
FIG. 13 is a perspective view of mounting means for a number of cases, as will be described.

FIG. 13 shows a display mount 80 for cases as described above. The mount contains slots 81 to receive plastic feet (in thin sheet form, for example) integral with the cases, as at **82*a* in FIGS. 1, 4 and 6; at 82*b* in FIGS. 9 and 10; and at 82*c* in FIG. 11**.

In summary, the invention enables safe storage in a small confined space of objects such as pendants, chains and the like; also the owner may safely transport such objects due to their compact confinement in small containers as described.

I claim:

1. In combination with a pendant, chain and clasp, a device for storing same comprising (a) a case including a receptacle and lid and having partitions to define a pendant chamber receiving the pendant, a chain chamber receiving the chain, and a clasp chamber receiving the clasp, (b) a peg in the clasp chamber removably retaining the clasp, the peg having a free end off which the clasp may be removed, (c) the chain extending in dual strand configuration generally cyclically between partitions, the chain chamber located between the clasp chamber and the pendant chamber and the partitions defining local slots sized to pass the chain between said chambers, whereby chain strand entanglement is prevented, (d) the case including a lid removably assembled to the receptacle to close over the chambers for retaining the pendant, chain and clasp therein.

2. The device of claim 1 wherein said slots are located proximate ends of the partitions.

3. The device of claim 1 wherein the lid consists of transparent material.

4. The device of claim 1 wherein the receptacle and lid consist of molded plastic material, the lid having hinge attachment to the receptacle.

5. The device of claim 4 wherein the receptacle is generally rectangular, and has width and length dimensions less than about 1½ inches.

6. The device of claim 1 including yieldable insert means in the chambers to be yieldably compressed by said pendant, chain, and clasp when the lid is assembled to the receptacle to close over the chambers.

7. The device of claim 1 wherein the chain chamber is lengthwise serpentine, and there being protrusion means spaced lengthwise of said chain chamber and projecting generally centrally therein to seperate two chain strands laying therein.

8. The device of claim 1 wherein the slots are adjacent the ends of the partitions, there being auxiliary partitions carried by the lid to project into said slots when the lid is closed over the chamber.

9. The device of claim 1 wherein the chain chamber extends about the pendant chamber, the receptacle is rectangular, and there are multiple clasp chamber at interior corners of the receptacle.

10. The device of claim 1 including a projecting foot on the case adapted to interfit a holder to mount the case for display.

* * * * *